United States Patent [19]

Irwin

[11] 4,407,654

[45] Oct. 4, 1983

[54] HANDLING AND SUPPORT SYSTEM FOR KILN FIRED WARE

[75] Inventor: David M. Irwin, East Liverpool, Ohio

[73] Assignee: The Potters Supply Company, East Liverpool, Ohio

[21] Appl. No.: 342,032

[22] Filed: Jan. 21, 1982

[51] Int. Cl.[3] ..... F27D 5/00

[52] U.S. Cl. ..... 432/258; 432/259

[58] Field of Search ..... 432/258, 259

[56] References Cited

U.S. PATENT DOCUMENTS 224,450 2/1880 Leak et al. ..... 432/259

2,881,502 4/1959 Dopera ..... 432/259

*Primary Examiner*—John J. Camby

*Attorney, Agent, or Firm*—Biebel, French & Nauman

[57] ABSTRACT

A framework for supporting ware to be kiln fired is constructed from a plurality of shelves or supporting arms which are engaged within horizontal slots in one or more vertical support posts. The shelves or supporting arms are secured to the support posts by locking pins which are inserted through apertures in the posts and shelves or support arms which apertures are aligned when the posts and shelves or support arms are properly engaged with one another. In an alternate embodiment, a supporting framework is constructed from vertical support members and support plates. Each vertical support member comprises a vertical support post preassembled with ware supporting arms which are interlocked to the post by a locking pin. Assembled vertical support members are received at either end by the support plates which include indentations for receiving the ends of the vertical support members.

18 Claims, 14 Drawing Figures

HANDLING AND SUPPORT SYSTEM FOR KILN FIRED WARE

BACKGROUND OF THE INVENTION

This invention relates to apparatus for supporting pottery or other ceramic material to be kiln fired.

A variety of supporting apparatus exists in the prior art. For example, where articles to be fired must be protected from the environment of the kiln, structures referred to as saggers have been provided. Saggers typically are cylindrical sections each of which receives a single piece of ware to be fired. The saggers are stacked one upon the other in an overlapping arrangement whereby each piece of ware is protected by the sagger and the piece of ware above it. For example, see U.S. Pat. No. 46,109.

Similarly, stacked support elements which do not afford such protection for the ware are generally triangular in shape and include interlocking lugs and seats in the top and bottom, respectively, of the remote portions of the support elements. Such support elements are referred to as cranks and kiln setters in U.S. Pat. Nos. 1,877,424 and 2,881,502. Stacked supports are difficult to handle and, due to their stacked construction, require time consuming assembly prior to firing and disassembly after firing. Stacked supports also require considerable space if storage is necessary.

Known firing support structures also include arrangements where sleeves are slidingly engaged with rods which extend vertically from a base member. The sleeves include ware supporting projections or serve to support and separate shelves which in turn support the ware. Examples are illustrated in British Pat. Nos. 406,809 and 477,486. Such structures, while providing improvements over stacked supports, still present handling problems and must be handled by the base member or have locking members attached to the upper ends of the rods to prevent the sleeves from sliding off the rods. Further, if a sleeve or associated ware supporting projection is damaged or contaminated, the entire structure must be disassembled to replace the section. This is a problem since ware supporting projections are easily damaged and often replaced between firings due to such damage and potential contamination.

Another support structure is disclosed in U.S. Pat. No. 4,184,841 wherein a frame is formed by top and bottom end units which are rigidly interconnected by separating pillars. The end units include structure for receiving detachably mounted ware supporting posts which include sockets wherein replaceable projecting pins or pegs are mounted to receive ware pieces. While such frames are more easily handled due to their rigid construction, the rigid construction also tends to make the frames prone to damage which may necessitate replacement of the entire rigid frame.

It is apparent that a need exists for an inexpensive, lightweight structure which provides versatility and ease of handling for supporting articles during kiln firing.

SUMMARY OF THE INVENTION

The shortcomings of the prior art are overcome in accordance with the present invention by a ware supporting framework which is constructed from a plurality of shelves or supporting arms which are engaged within horizontal slots in one or more vertical support posts. Apertures are formed in an axially aligned column through the portion of the vertical support posts which define the slots. Apertures are also formed in the portions of the shelves and arms which are engaged within the slots. The shelf and arm apertures align with the post apertures when a shelf or arm is properly engaged within a post slot. A supporting framework is formed by inserting locking pins through the aligned apertures in the posts and shelves or support arms to interlock the shelves or arms to the posts. The locking pins include extended portions or heads which are larger than the apertures in the vertical support posts to prevent the pins from falling through the framework.

Advantageously, the framework can be handled by the vertical support posts which engage the ware supporting shelves or arms and are locked thereto by the locking pins.

Further, if a support post, shelf or arm must be replaced, such replacement is conveniently accomplished by removing the associated locking pin or pins, replacing the damaged part, and replacing the locking pin or pins to reassemble the framework.

Furthermore, the shelves and supporting arms can be intermixed within a framework for special applications wherein a variety of articles are to be fired at the same time and a given support post can be utilized for a variety of sizes of ware supporting shelves or arms to reduce the inventory of parts required to assemble a variety of frameworks, as well as providing versatility of assembled frameworks.

In accordance with an alternate embodiment of the present invention, a ware supporting framework is constructed from vertical support members which each comprise a post preassembled with ware supporting arms with the vertical support members being engaged in support plates. Each required vertical support member is constructed by placing ware supporting arms within selected slots of a vertical support post to define desired spacing for ware during firing. The ware supporting arms are then secured to the post by a locking pin to form a vertical support member. The support plates include indentations or are otherwise formed to receive the upper and lower ends of each vertical support member required for a given framework.

Indentations can be formed on one or both sides of the support plates. Indentations formed on both sides of the support plates facilitate tiered frameworks or stacking and reduce the number of plates required for such tiered framework applications. On the other hand, indentations on only one side of the support plates reduce the weight and mass of each plate. It may be desirable to make the upper and lower support plates identical to one another to reduce inventory and manufacturing costs although a given framework may use both types of support plates.

In this alternate embodiment of the invention, the vertical support members can be conveniently removed for storage or the renewal of ware supporting elements or damaged parts by removing the top support plate and lifting the vertical support member or members from the bottom support plate. Thus, this embodiment permits compact storage of component parts of a framework while permitting rapid assembly and disassembly as needed.

It is an object of the present invention to provide an efficient and economical handling and support system for articles to be subjected to a firing process.

It is another object of the present invention to provide a lightweight interlocking framework for supporting articles to be subjected to a firing process wherein a variety of supporting structures can be interchanged to provide support for a variety of articles and allow economical replacement of damaged or contaminated components of the framework.

It is yet another object of the present invention to provide a framework wherein vertical support members are formed by interlocking ware supporting arms to vertical support posts and removably engaging the ends of a required number of such vertical support members in upper and lower support plates to form the framework.

These, as well as other objects and advantages of the present invention, will become more apparent upon a review of the detailed description of the invention when read with reference to the drawings.

DETAILED DESCRIPTION OF THE INVENTION

In accordance with the present invention, a variety of frameworks are provided for supporting articles to be kiln fired. With reference to the drawings, each framework comprises at least one vertical support post to which ware supporting members are interlocked by locking pins which are inserted through aligned holes in the posts and ware supporting members. Component parts of the frameworks are generally interchangeable and can be used in various framework sizes to add to the versatility of the frameworks and reduce required component inventories.

The vertical support posts 100 are preferably formed by extrusion from a ceramic material; however, other forms of construction from metal or other materials having suitable strength and temperature characteristics may be more desirable for specific applications. Each post 100, as extruded, includes a columnar bore 102 which extends longitudinally through the post. Slots 104 are machined or otherwise formed in the post to intersect the bore 102 and the posts are then fired. The bore 102 and slots 104 are dimensioned to allow for shrinkage which occurs during firing.

Figure 1:
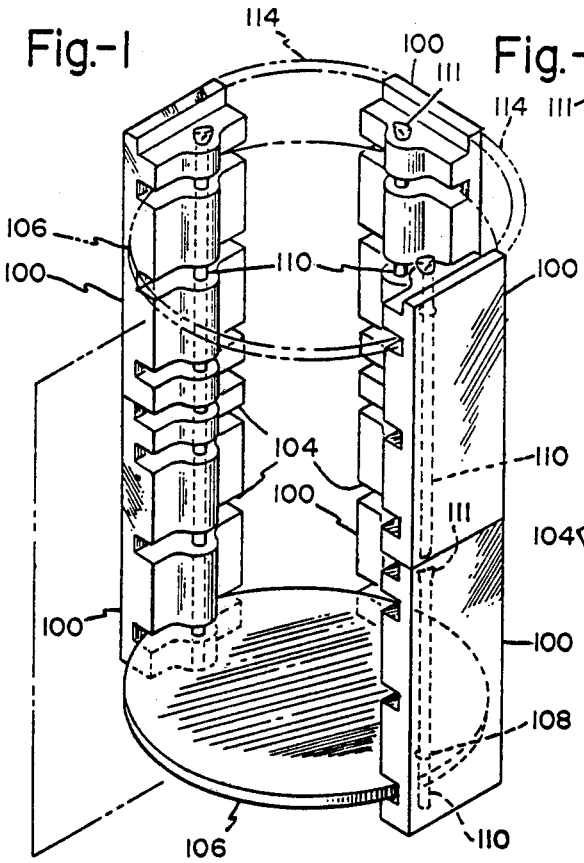
FIG. 1 is a perspective view of two stacked ware supporting frameworks in accordance with the present invention which each incorporate ware supporting shelves.

Ware supporting members in the form of shelves 106, as shown in the embodiment of FIG. 1, are formed to be received within the slots 104 of the posts 100. Apertures 108 are formed in the periphery of the shelves 106, as best seen in FIGS. 5*a* through 5*f*, so that when the shelves 106 are engaged in the slots 104 of the posts 100, the apertures 108 in the shelves 106 are aligned with the bores 102 in the posts 100. A ware supporting framework is formed by inserting locking pins 110 through the bores 102 of the posts 100 and the aligned apertures 108 of the shelves 106. The shelves 106 and locking pins 110 are preferably formed from a ceramic material with the pins being formed by extrusion; however, other forms of construction from metal or other materials having suitable strength and temperature characteristics may be more desirable for specific applications. The locking pins 110 include heads 111 which can be formed by pinching or otherwise deforming the tip end of the pins 110 prior to firing when the pins are formed from ceramic material.

Figure 3:
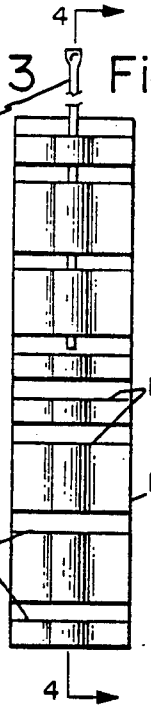
FIG. 3 is a perspective view of two vertical support posts utilized in the present invention.
Figure 4:
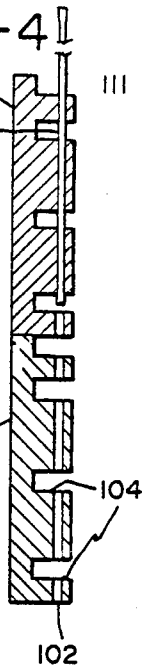
FIG. 4 is a cross-sectional view of the vertical support posts of FIG. 3 taken along the line 4—4.

The shelves 106, as shown in FIG. 1, are circular; however, shelves of virtually any shape can be constructed to receive a particular piece of ware or article which is to be kiln fired. FIGS. 5*a* through 5*f* illustrate a small variety of the potential shelves 106 which are possible in accordance with the present invention. As shown in FIGS. 5*a* through 5*f*, two or more vertical support posts 100, as shown in FIGS. 3 and 4, are contemplated for use with the illustrated shelves. Weight-/mass reducing sections 112 can be cut from the shelves 106 and the upper surfaces of the shelves can be ribbed to reduce contact with ware supported thereon.

Figure 2:
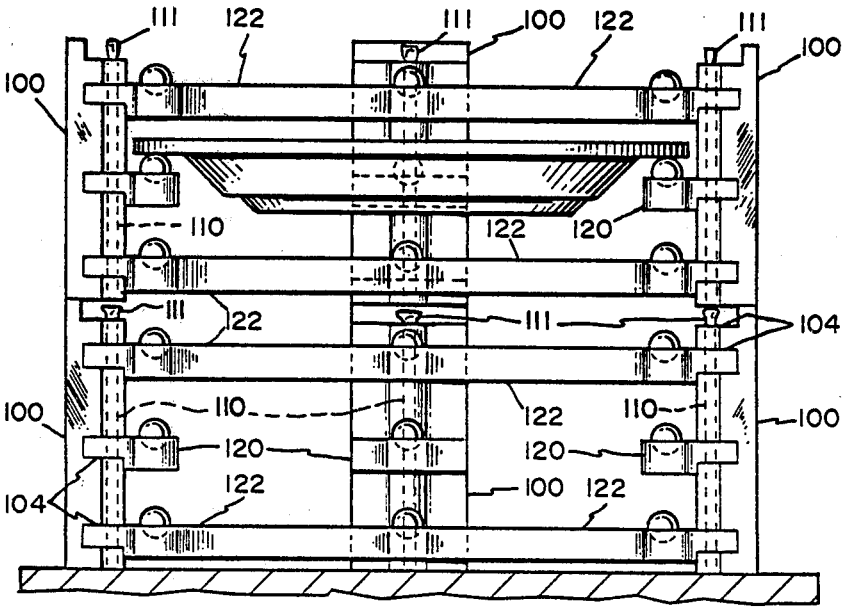
FIG. 2 is a front view of two stacked frameworks in accordance with the present invention which each incorporate ware supporting arms.
Figure 5A:
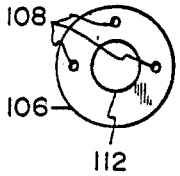
FIGS. 5*a* through 5*f* show a number of the wide variety of shelf formations which can be utilized in the present invention.
Figure 5B:
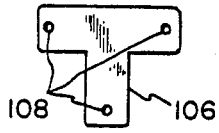
Figure 5C:
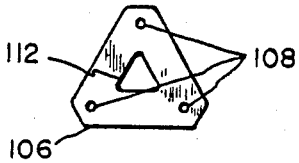
Figure 5D:
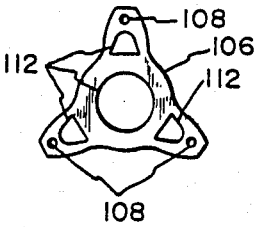
Figure 5E:
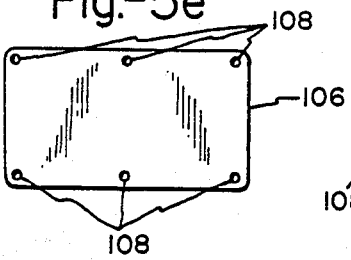
Figure 5F:
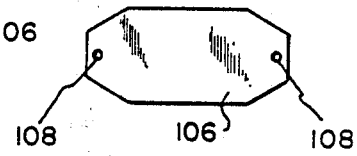
Figure 7:
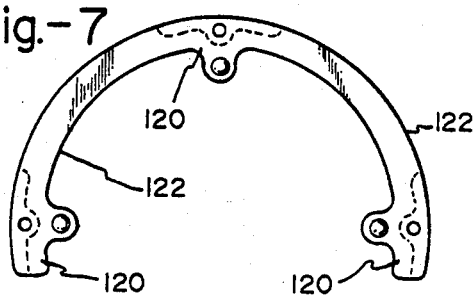
FIG. 7 is a plan view of three of the supporting arms shown in FIGS. 2 and 6 incorporating tying members for stabilizing and dimensioning the framework of FIG. 2.
Figure 9:
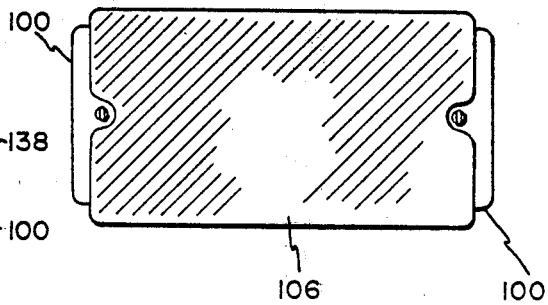
FIG. 9 is a plan view of an embodiment incorporating two vertical support posts.

Although any post shape can be used for the posts of the present invention, the shape of the posts 100, illustrated in detail in FIGS. 3 and 4, has been found suitable for extrusion while providing sufficient strength for the frameworks. This post shape also reduces the weight and mass of the frameworks to help minimize the amount of energy required to fire articles supported thereon. However, the posts can be widened, narrowed or otherwise varied in size and shape according to the requirements of the particular framework to be assembled. Thus, two widened posts can be utilized to support a framework as shown in FIG. 9 or a single wide post arcuate in shape can be utilized, as shown by dotted lines 114 in FIG. 1. The use of such varying sized posts, while being contemplated in accordance with the present invention and possibly preferred in certain applications, has disadvantages. For example, additional post varieties must be inventoried, frameworks constructed from such posts may tend to have more weight and mass, and such posts are not as compact for storage or shipment.

Where two or more separate posts 100 are utilized (two posts are shown in FIG. 9, three posts as shown in FIG. 1) to construct a framework from shelves, the continuity of the structure of the shelves serve to stabilize and dimension the framework so constructed. However, when separate ware supporting arms 120 are utilized in a framework, as shown in FIG. 2, tying members 122 must be connected to selected ones of the supporting arms 120 to stabilize and dimension the framework so constructed. The tying members 122 are preferably formed as a unitary piece with the ware supporting arms 120 with which they are associated, as shown in FIG. 7.

Figure 6:
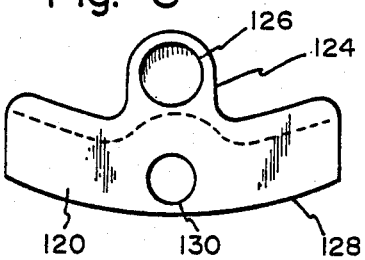
FIG. 6 is a plan view of a supporting arm of the embodiment of FIG. 2.

An illustrative ware supporting arm 120 is shown in FIG. 6. The ware supporting arm 120 includes an extension 124 which includes a socket 126 for receiving a ware supporting element such as a pin, disc, rod or ball, and together they form a ware support member which may be used as an alternative to shelves 106. Such ware supporting elements provide minimum contact with and marking of the ware pieces, and are well known in the art. The ware supporting arm 120 has an arcuate outer face 128 which generally corresponds to the contour of the slots 104 formed in the posts 100. A hole or aperture 130 is formed in the supporting arm 120 to receive the locking pin 110 and interlock the ware supporting arms 120 to a post 100.

To permit one framework to be stacked upon another, the posts 100 are preferably formed so that the heads 111 of the locking pins 110 are recessed below the upper surface of the posts 100. The preferred formation of the posts 100 to recess the heads 111 of the locking pins 110 is by the positioning of the uppermost slot 104 so that the upper surface of the post corresponding to the slot is removed. The head 111 of the locking pin 110 is formed to be of a height less than the width of the slot 104 so formed and, accordingly, the top of the head 111 is recessed below the remaining upper surface of the post 100. The head recessing slot or uppermost slot 104 can be formed in the posts 100 at the same time as the other slots 104 and is, accordingly, conveniently and economically formed. Of course, other head recessing arrangements such as sockets or other depressions can be used in the present invention.

Two stacked frameworks are shown in FIGS. 1 and 2 with each framework having support positions for three ware pieces. Of course, single frameworks having more ware supporting positions can be formed in accordance with the present invention (see FIG. 8). When more ware supporting positions are provided in a framework comprising ware supporting arms, it is noted that it may be desirable to provide tying members at more than two supporting arm locations to insure stability of the framework.

Figure 8:
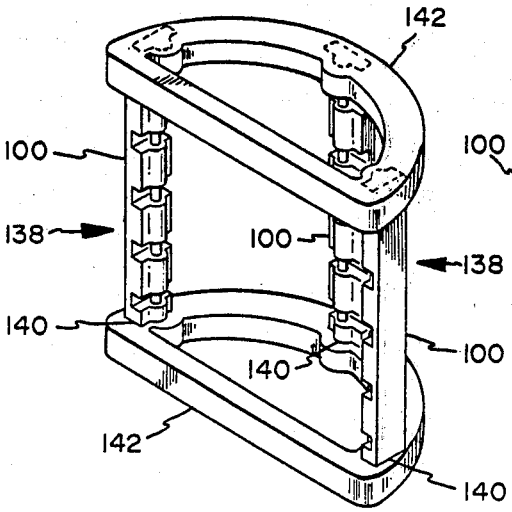
FIG. 8 is a perspective view of an alternate embodiment in accordance with the present invention.

In the event that frameworks are to be disassembled between firings, an alternate embodiment shown in FIG. 8 facilitates rapid assembly and disassembly. The embodiment of FIG. 8 incorporates the advantages of the slotted, locking pin construction in accordance with the present invention into a framework which includes two or more vertical support members which remain assembled upon removal from the framework. In the embodiment of FIG. 8, a vertical support member 138 is constructed by placing a plurality of ware supporting arms (not shown) within the slots 104 of a post 100 and inserting a locking pin 110 through the aligned apertures of the post and supporting arms. The supporting arms for use in the embodiment of FIG. 8 can, for example, be the supporting arms shown in FIGS. 2 and 6. For assembly of the framework, the required number of vertical supports 138 so formed are placed within indentations 140 of a support plate 142, and another support plate 142, which may be identical, is inverted and placed upon the upper ends of the vertical supports to form the framework as shown in FIG. 8. To facilitate tiered assembly of frameworks, indentations may be placed on both sides of the support plates. Similar to the shelves 106, the support plates can also be any shape. Thus, a large variety of support plates having indentations or other post receiving structure on one or both sides and having essentially any shape are contemplated in accordance with the present invention.

FIG. 9 shows a plan view of an embodiment of the present invention comprising two widened posts 100 and rectangular shelves 106 which can be advantageously used to fire rectangular ceramic tiles or the like.

It is apparent from the above description that an improved handling and support system for kiln fired ware has been disclosed. As indicated by the alternative embodiments disclosed and suggested herein, a large variety of modifications and changes can be made in the illustrated embodiments without departing from the true spirit and scope of the invention. For example, a large variety of formations of the ware supporting arms, including one or more ware supporting elements, are possible, as well as a large variety of post and shelf formations. Accordingly, while the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. Apparatus for handling and supporting ware which is subjected to firing during production, said apparatus comprising:

ware supporting means adapted to receive and support said ware;

vertical support means for receiving and supporting said ware supporting means so that ware placed on said ware supporting means are separated and spaced apart from one another, said ware supporting means and said vertical support means each including apertures formed therein which apertures align with one another when said ware supporting means is received within said vertical support means; and locking means received within said aligned apertures for locking said ware supporting means to said vertical support means to form a framework for handling and supporting articles for firing.

2. The apparatus of claim 1 wherein said vertical support means comprises at least one vertical support post having a plurality of generally horizontal slots formed therein for receiving said ware supporting means within said slots, said post including at least one series of aligned apertures extending through said slots for receiving said locking means.

3. The apparatus of claim 2 wherein said vertical support means includes at least two vertical support posts and said ware supporting means includes tying means for positioning said vertical support posts relative to one another to form and dimension said framework.

4. The apparatus of claim 3 wherein said ware supporting means comprises at least two shelves.

5. The apparatus of claim 3 wherein said ware supporting means comprises a plurality of ware supporting arms with said tying means interconnecting selected ones of said plurality of ware supporting arms to form and dimension said framework.

6. The apparatus of claim 3, 4 or 5 wherein said locking means comprises at least one locking pin for each of said vertical support posts, said locking pins including means for retaining said pins within said apparatus.

7. The apparatus of claim 6 wherein said pin retaining means comprises an end section enlarged to be greater than any of said apertures.

8. The apparatus of claim 7 wherein said vertical support posts include means formed therein for receiving the enlarged end sections of said pins whereby said end sections are below the upper surfaces of said posts to allow stacking of multiple units of said apparatus.

9. The apparatus of claim 8 wherein said receiving means comprises a slot formed in the upper surface of each of said vertical support posts and through the uppermost aperture thereof.

10. A framework for handling and supporting ware to be produced by firing and comprising:

at least two vertical support posts each of which includes a plurality of horizontally spaced apart slots extending partially through said members and a series of axially aligned apertures formed through the portions of said members defining said slots;

ware supporting means positioned within selected ones of said slots and including apertures aligned with said apertures of said vertical support posts when so positioned, said ware supporting means including tying means extending between said vertical support posts to form and dimension said framework; and locking pins inserted through the apertures of said vertical support posts and said ware supporting means to form said framework, said pins including means for retention within said framework.

11. The framework of claim 10 wherein said ware supporting means comprises at least two shelves.

12. The framework of claim 10 wherein said ware supporting means comprises a plurality of ware supporting arms with said tying means interconnecting selected ones of said plurality of ware supporting arms to form and dimension said framework.

13. The framework of claim 11 or 12 wherein said retention means comprises a head on each of said locking pins sized to prevent passage through said apertures and said vertical support posts including slots formed into their upper surfaces to receive said heads whereby one framework can be stacked upon another.

14. Apparatus for supporting ware which is subjected to firing during production comprising:

a plurality of ware supporting arms;

at least two vertical support posts having upper and lower ends and engaging said ware supporting arms, said ware supporting arms and said vertical support posts including apertures formed therein which apertures are aligned when said supporting arms and support posts are engaged;

locking pins received within said aligned apertures for locking said ware supporting arms into said vertical support posts;

a first support plate including means for engaging said lower ends of said vertical support posts; and a second support plate including means for engaging said upper ends of said vertical support posts whereby ware supporting apparatus is formed which can be readily assembled and disassembled.

15. The apparatus of claim 14 wherein said engaging means comprises indentations shaped to receive the ends of said vertical support posts.

16. The apparatus of claim 14 or 15 wherein said first support plate is identical to said second support plate.

17. The apparatus of claim 14 or 15 wherein said second support plate comprises engaging means on both sides thereof whereby tiered levels of said apparatus can be assembled with a single support plate interposed between any two tiered levels of said apparatus.

18. The apparatus of claim 5, 12, 14 or 15 wherein said ware supporting arms comprise means for receiving renewable article supporting elements.

* * * * *